US009997287B2

(12) United States Patent
Fochtman

(10) Patent No.: US 9,997,287 B2
(45) Date of Patent: Jun. 12, 2018

(54) ELECTROMAGNETIC SOLENOIDS HAVING CONTROLLED RELUCTANCE

(71) Applicant: Synerject LLC, Newport News, VA (US)

(72) Inventor: James P. Fochtman, Williamsburg, VA (US)

(73) Assignee: SYNERJECT LLC, Newport News, VA (US)

( * ) Notice: Subject to any disclaimer, the term of this patent is extended or adjusted under 35 U.S.C. 154(b) by 475 days.

(21) Appl. No.: 14/569,119

(22) Filed: Dec. 12, 2014

(65) Prior Publication Data

US 2015/0357107 A1 Dec. 10, 2015

Related U.S. Application Data

(60) Provisional application No. 62/008,719, filed on Jun. 6, 2014.

(51) Int. Cl.

| | |
|---|---|
| ***H01F 7/08*** | (2006.01) |
| ***H01F 41/04*** | (2006.01) |
| ***H01F 7/13*** | (2006.01) |

(52) U.S. Cl.

CPC ..... *H01F 7/08* (2013.01); *H01F 7/081* (2013.01); *H01F 7/13* (2013.01); *H01F 41/04* (2013.01); *Y10T 29/49021* (2015.01)

(58) Field of Classification Search

CPC ... H01F 7/08; H01F 7/13; H01F 7/081; H01F 2007/086

USPC ..... 335/261, 262, 279, 281

See application file for complete search history.

(56) References Cited

U.S. PATENT DOCUMENTS

| | | | |
|---|---|---|---|
| 1,625,789 | A | 4/1927 | Braselton et al. |
| 1,661,359 | A | 3/1928 | Chryst et al. |
| 2,091,499 | A | 8/1937 | Brown |
| 2,222,823 | A | 11/1940 | Parenti |

(Continued)

FOREIGN PATENT DOCUMENTS

| | | | |
|---|---|---|---|
| CN | 2916171 | Y | 6/2007 |
| DE | 100 28 458 | A1 | 12/2001 |

(Continued)

OTHER PUBLICATIONS

PCT/US2015/030264 International Search Report and the Written Opinion of the International Search Authority dated May 12, 2015.

(Continued)

*Primary Examiner* — Ramon M Barrera

(57) ABSTRACT

An apparatus includes a housing, a solenoid coil disposed within the housing, a pole member, and an armature configured to move from a first position to a second position when the solenoid coil is energized. A contact surface of the armature is spaced apart from a contact surface of the pole member by a first distance when the armature is in the first position, and a second distance when the armature is in the second position. The housing, the pole member and the armature collectively define a flux path characterized by a first reluctance when the armature is in the first position and a second reluctance when the armature is in the second position. The difference between the first reluctance and the second reluctance is less than about thirty percent of the value of the first reluctance.

20 Claims, 9 Drawing Sheets

(56) References Cited

U.S. PATENT DOCUMENTS

| | | | | |
|---|---|---|---|---|
| 2,369,282 | A | 2/1945 | Curtis et al. | |
| 2,984,187 | A | 5/1961 | Prasse et al. | |
| 3,181,194 | A | 5/1965 | Daykin et al. | |
| 3,507,263 | A | 4/1970 | Long | |
| 3,515,167 | A | 6/1970 | Svenson | |
| 4,203,395 | A | 5/1980 | Cromas et al. | |
| 4,394,148 | A | 7/1983 | Ryan | |
| 4,422,420 | A | 12/1983 | Cromas et al. | |
| 4,860,714 | A | 8/1989 | Bucci | |
| 4,928,656 | A | 5/1990 | Ausiello | |
| 4,932,439 | A | 6/1990 | McAuliffe, Jr. | |
| 4,949,215 | A | 8/1990 | Studtmann et al. | |
| 5,070,849 | A | 12/1991 | Rich et al. | |
| 5,080,077 | A | 1/1992 | Sawert et al. | |
| 5,103,793 | A | 4/1992 | Riese et al. | |
| 5,161,083 | A | 11/1992 | Mohler et al. | |
| 5,289,810 | A | 3/1994 | Bauer et al. | |
| 5,341,842 | A | 8/1994 | Chih et al. | |
| 5,361,742 | A | 11/1994 | Briggs et al. | |
| 5,389,245 | A | 2/1995 | Jaeger et al. | |
| 5,415,146 | A | 5/1995 | Tuckey | |
| 5,452,701 | A | 9/1995 | Tuckey | |
| 5,458,767 | A | 10/1995 | Stone | |
| 5,469,829 | A | 11/1995 | Kleppner et al. | |
| 5,520,156 | A | 5/1996 | Brunnhofer | |
| 5,579,739 | A | 12/1996 | Tuckey et al. | |
| 5,590,631 | A | 1/1997 | Tuckey | |
| 5,647,330 | A | 7/1997 | Sawert et al. | |
| 5,649,514 | A | 7/1997 | Okada et al. | |
| 5,655,504 | A | 8/1997 | Iwai | |
| 5,715,798 | A | 2/1998 | Bacon et al. | |
| 5,718,208 | A | 2/1998 | Brautigan et al. | |
| 5,727,529 | A | 3/1998 | Tuckey | |
| 5,743,239 | A | 4/1998 | Iwase | |
| 5,769,061 | A | 6/1998 | Nagata et al. | |
| 5,791,317 | A | 8/1998 | Eck | |
| 5,960,775 | A | 10/1999 | Tuckey | |
| 6,076,550 | A * | 6/2000 | Hiraishi | F16K 31/0655 137/550 |
| 6,102,679 | A | 8/2000 | Brown | |
| 6,106,244 | A | 8/2000 | Nakatsukasa et al. | |
| 6,113,781 | A | 9/2000 | Popoff et al. | |
| 6,119,655 | A | 9/2000 | Heinitz et al. | |
| 6,123,521 | A | 9/2000 | Mori et al. | |
| 6,142,126 | A | 11/2000 | Kanamaru | |
| 6,149,399 | A | 11/2000 | Bowser et al. | |
| 6,155,793 | A | 12/2000 | Tuckey et al. | |
| 6,209,309 | B1 | 4/2001 | McArthur | |
| 6,213,143 | B1 | 4/2001 | Schwegler et al. | |
| 6,213,726 | B1 | 4/2001 | Tuckey | |
| 6,216,671 | B1 | 4/2001 | Sawert et al. | |
| 6,220,454 | B1 | 4/2001 | Chilton | |
| 6,240,902 | B1 | 6/2001 | Tanaka et al. | |
| 6,241,883 | B1 | 6/2001 | Noda | |
| 6,253,735 | B1 | 7/2001 | Miyajima | |
| 6,260,543 | B1 | 7/2001 | Chih | |
| 6,273,056 | B1 | 8/2001 | Shirakawa et al. | |
| 6,293,770 | B1 | 9/2001 | Matsumoto et al. | |
| 6,296,012 | B1 | 10/2001 | Kilgore et al. | |
| 6,311,725 | B1 | 11/2001 | Hamada et al. | |
| 6,343,589 | B1 | 2/2002 | Talaski et al. | |
| 6,364,630 | B1 | 4/2002 | Craft et al. | |
| 6,422,836 | B1 | 7/2002 | Krueger et al. | |
| 6,424,924 | B1 | 7/2002 | Wagner et al. | |
| 6,439,205 | B2 | 8/2002 | Ushigome | |
| 6,457,458 | B1 | 10/2002 | Frank et al. | |
| 6,488,476 | B2 | 12/2002 | Eck | |
| 6,491,029 | B2 | 12/2002 | Kondou et al. | |
| 6,520,163 | B2 | 2/2003 | Yoshioka et al. | |
| 6,615,780 | B1 | 11/2003 | Lin et al. | |
| 6,659,085 | B2 | 12/2003 | Kojima | |
| 6,679,227 | B2 | 1/2004 | Sawert et al. | |
| 6,719,539 | B1 | 4/2004 | Yoshioka | |
| 6,725,837 | B2 | 4/2004 | Hiraku et al. | |
| 6,729,309 | B2 | 5/2004 | Schueler | |
| 6,733,249 | B2 | 5/2004 | Maier et al. | |
| 6,773,241 | B2 | 8/2004 | Suzuki et al. | |
| 6,786,709 | B1 | 9/2004 | Klahm et al. | |
| 6,805,331 | B2 | 10/2004 | Burrola et al. | |
| 6,925,990 | B1 | 8/2005 | Konopacki | |
| 6,928,989 | B2 | 8/2005 | Powell | |
| 6,976,473 | B2 | 12/2005 | Boos et al. | |
| 6,981,490 | B2 | 1/2006 | Nagata et al. | |
| 7,021,603 | B2 | 4/2006 | Wygnaski | |
| 7,069,912 | B2 | 7/2006 | Yoshioka | |
| 7,111,460 | B2 | 9/2006 | Jensen et al. | |
| 7,117,854 | B2 | 10/2006 | Schmitt | |
| 7,146,968 | B2 | 12/2006 | Koito et al. | |
| 7,209,020 | B2 | 4/2007 | Telep | |
| 7,228,844 | B2 | 6/2007 | Ricco et al. | |
| 7,237,538 | B2 | 7/2007 | Perruchot et al. | |
| 7,246,636 | B2 | 7/2007 | Dudra et al. | |
| 7,246,787 | B2 | 7/2007 | Kumar | |
| 7,296,980 | B2 | 11/2007 | Olivieri et al. | |
| 7,412,968 | B2 | 8/2008 | Takayanagi et al. | |
| 7,444,988 | B2 | 11/2008 | Ricco et al. | |
| 7,481,337 | B2 | 1/2009 | Luharuka et al. | |
| 7,552,720 | B2 | 6/2009 | Borg et al. | |
| 7,617,814 | B2 | 11/2009 | Leppert | |
| 7,677,225 | B2 | 3/2010 | Radue et al. | |
| 7,747,377 | B2 | 6/2010 | Nakata et al. | |
| 7,753,657 | B2 | 7/2010 | Strauss et al. | |
| 7,775,235 | B2 | 8/2010 | Leppert et al. | |
| 7,784,447 | B2 | 8/2010 | Ricco et al. | |
| 7,845,343 | B2 | 12/2010 | Imai | |
| 8,018,695 | B2 | 9/2011 | Serizawa et al. | |
| 8,079,479 | B2 | 12/2011 | Leppert | |
| 8,113,796 | B2 | 2/2012 | Marx et al. | |
| 8,427,263 | B2 | 4/2013 | Hoppe et al. | |
| 9,004,884 | B2 | 4/2015 | Leppert et al. | |
| 2002/0152996 | A1 | 10/2002 | Gabauer et al. | |
| 2003/0000502 | A1 | 1/2003 | Jones et al. | |
| 2003/0024509 | A1 | 2/2003 | Matusek et al. | |
| 2003/0127075 | A1 | 7/2003 | Braun et al. | |
| 2003/0131828 | A1 | 7/2003 | Crary | |
| 2004/0000344 | A1 | 1/2004 | Okabe et al. | |
| 2004/0037713 | A1 | 2/2004 | Schelhas et al. | |
| 2004/0076528 | A1 | 4/2004 | Kolb et al. | |
| 2004/0173187 | A1 | 9/2004 | Kanamaru et al. | |
| 2005/0145812 | A1 | 7/2005 | Kumar | |
| 2005/0178853 | A1 | 8/2005 | Doble et al. | |
| 2006/0021603 | A1 | 2/2006 | Nagata | |
| 2006/0024176 | A1 | 2/2006 | Ikeya | |
| 2006/0070941 | A1 | 4/2006 | Cline et al. | |
| 2006/0096582 | A1 | 5/2006 | Powell et al. | |
| 2006/0130815 | A1 | 6/2006 | Gaffield et al. | |
| 2006/0231079 | A1 | 10/2006 | Paluszewski | |
| 2007/0074770 | A1 | 4/2007 | Witherspoon et al. | |
| 2007/0113830 | A1 | 5/2007 | Koito et al. | |
| 2007/0128049 | A1 | 6/2007 | Sanchez et al. | |
| 2007/0204835 | A1 | 9/2007 | Xi et al. | |
| 2007/0272217 | A1 | 11/2007 | Kubota et al. | |
| 2010/0047090 | A1 | 2/2010 | Marx et al. | |
| 2010/0163327 | A1 | 7/2010 | Bernier et al. | |
| 2010/0269789 | A1 | 10/2010 | Jensen et al. | |
| 2011/0097228 | A1 | 4/2011 | Tokuo et al. | |
| 2011/0098906 | A1 | 4/2011 | Barrows et al. | |
| 2011/0192381 | A1 | 8/2011 | Maruyama et al. | |
| 2011/0194946 | A1 | 8/2011 | Bedard et al. | |
| 2011/0200472 | A1 | 8/2011 | Leppert et al. | |
| 2011/0217186 | A1 | 9/2011 | Yoshizawa et al. | |
| 2011/0253918 | A1* | 10/2011 | Rampen | F04B 7/0076 251/65 |
| 2011/0285484 | A1 | 11/2011 | Hoppe | |
| 2012/0000445 | A1 | 1/2012 | Borg et al. | |
| 2012/0080367 | A1 | 4/2012 | Leppert | |

FOREIGN PATENT DOCUMENTS

| | | |
|---|---|---|
| DE | 103 28 206 A1 | 1/2005 |
| DE | 20 2006 010 856 U1 | 3/2008 |
| EP | 1 508 688 A1 | 2/2005 |
| GB | 2 328 659 A | 3/1999 |

(56) References Cited

FOREIGN PATENT DOCUMENTS

| | | | |
|---|---|---|---|
| JP | 2005-256741 | A | 9/2005 |
| TW | I412677 | | 10/2013 |
| WO | WO 2008/049900 | A1 | 5/2008 |

OTHER PUBLICATIONS

Chinese Office Action dated Nov. 1, 2017 for corresponding Chinese application No. 201580030183.4.

* cited by examiner

ELECTROMAGNETIC SOLENOIDS HAVING CONTROLLED RELUCTANCE

CROSS REFERENCE TO RELATED APPLICATIONS

This application claims the benefit of priority to U.S. Provisional Application No. 62/008,719, filed Jun. 6, 2014, entitled "Electromagnetic Solenoids Having Controlled Reluctance," the disclosure of which is incorporated by reference herein in its entirety.

BACKGROUND

The embodiments described herein relate to design and construction of electromagnetic solenoids, and more particularly, to a solenoid assembly designed and configured to have a controlled reluctance based on air gap geometries, leading to a controlled magnetic force during the operation of the solenoid assembly.

Known solenoid assemblies are used in a variety of different applications. For example, known solenoid pumps are used in a variety of vehicle applications, such as, for example, to transfer oil, fuel and/or other fluids to facilitate the operation of the vehicle.

Solenoid pumps can be configured to receive an electrical current to cause an armature to move, thus actuating a pumping mechanism to enable transfer of fluid. In most known systems, the armature can be moved along a fixed stroke length, wherein the distance between two end-stops is fixed. Similarly stated, in normal operation, when the solenoid is actuated, the armature moves a fixed distance or "stroke." An actuator rod can be coupled to the armature such that movement of the armature results in a corresponding movement of the actuator rod, which actuates the pumping mechanism (e.g., reciprocating pump).

For known spring biased electromagnetic solenoids, a magnetic force is generated in the solenoid when the electrical current passes through the coil, thus causing the armature to move between the two end-stops. When a solenoid assembly, for example, a solenoid fuel injector, is required to operate at a high frequency, the magnetic force must be generated and decayed quickly. However, when the armature approaches a pole (or end-stop) of the solenoid, the magnetic force changes to a substantially higher value, and this high magnetic force is difficult to manage in such high frequency solenoid applications due to the time period required for the magnetic force to decay. Similarly stated, some known solenoids produce a magnetic force acting on the armature that changes, sometimes considerably, as a function of the distance between the armature and the pole (or end-stop).

Accordingly, some known systems are configured to implement a peak and hold driver to reduce the magnetic field by reducing the electrical current that passes through the solenoid when the armature approaches the pole (or end-stop). Such known systems, however, are expensive, cumbersome and require additional hardware.

Thus, a need exists for an improved and easy-to-implement solenoid design which provides a controlled magnetic force during operation of the solenoid.

SUMMARY

Electromagnetic solenoid assemblies are described herein. In some embodiments, an electromagnetic solenoid assembly includes an armature and a pole member (or end-stop). The solenoid assembly defines a flux path through which a magnetic field passes when the solenoid is energized. The flux path is characterized by a first reluctance when the armature is in a closed position (i.e., at a maximum distance from the pole, when the solenoid is not energized) and a second reluctance when the armature is in an opened position (i.e., at a minimum distance from the pole member, when the solenoid is energized). The first reluctance and the second reluctance can be produced and/or influenced by any suitable aspect of the solenoid, such as, for example, air gaps within the flux path, intrinsic properties of the materials that define the flux path and the like. The difference between the first reluctance and the second reluctance is less than about thirty percent of the value of the first reluctance.

In some embodiments, an apparatus includes a housing, a solenoid coil disposed within the housing, a pole member, a retainer and an armature. The retainer is configured to retain the solenoid coil within the housing. The armature is configured to move from a first position to a second position when the solenoid coil is energized. A first surface of the armature is spaced apart from a contact surface of the pole member by a first air gap when the armature is in the first position. The first surface of the armature is in contact with the contact surface of the pole member when the armature is in the second position. A second surface of the armature spaced apart from a surface of the retainer portion by a second air gap. The housing, the pole member, the armature and the retainer collectively define a flux path including the first air gap and the second air gap. A portion of the first surface of the armature and a portion of the contact surface of the pole member define a first air gap area within the flux path. The pole member and the armature are configured such that the first air gap area decreases as the armature moves from the first position to the second position.

DETAILED DESCRIPTION

Figure 1A:
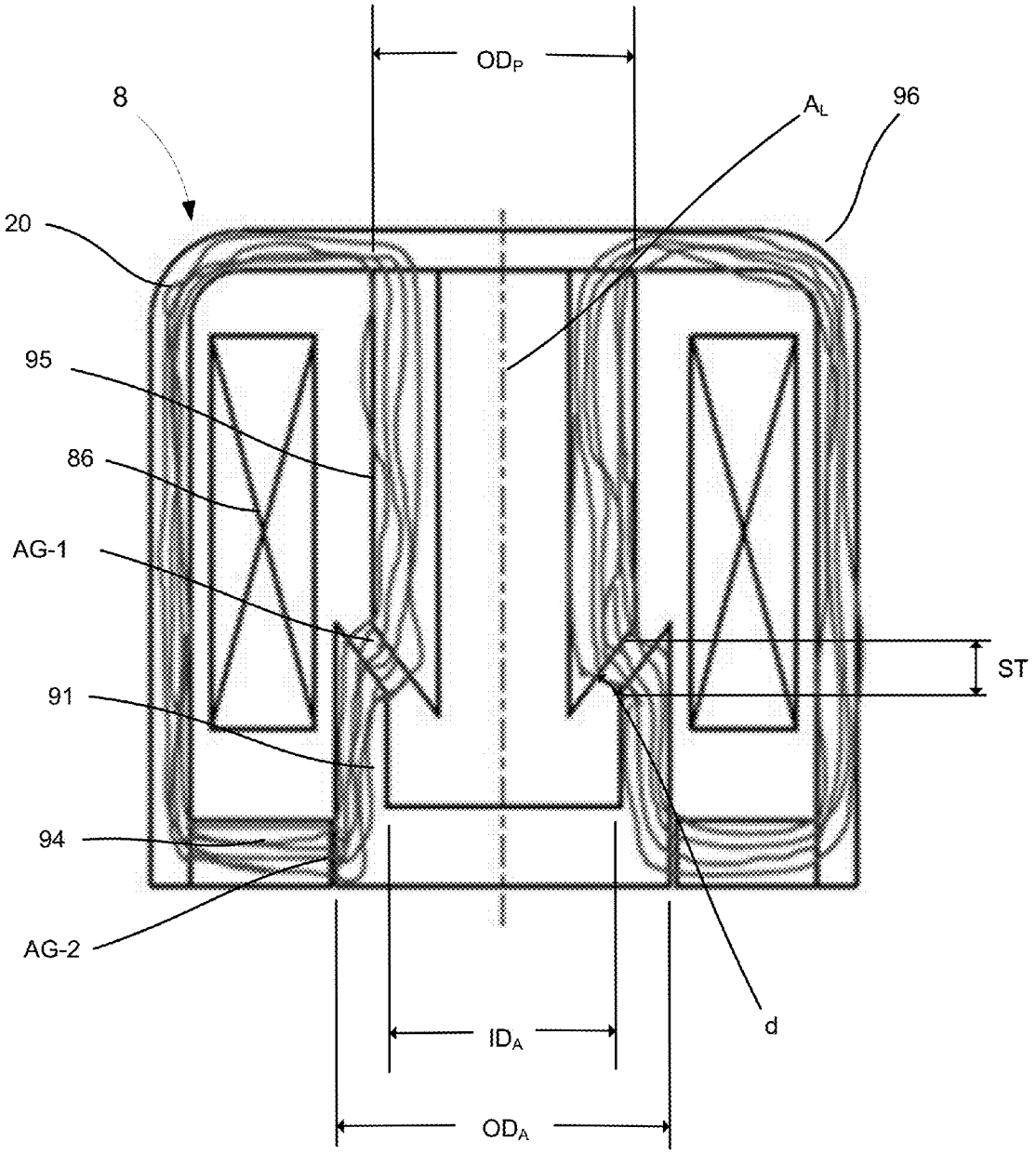
FIGS. 1A-1B are schematic illustrations of an electromagnetic solenoid assembly with magnetic field lines in a first configuration and a second configuration, respectively, according to an embodiment.

Electromagnetic solenoid assemblies are described herein. In some embodiments, an electromagnetic solenoid assembly includes an armature and a pole (or end-stop). The solenoid assembly defines a flux path through which a magnetic field passes when the solenoid is energized. The flux path is characterized by a first reluctance when the armature is in a closed position (i.e., at a maximum distance from the pole, when the solenoid is not energized) and a second reluctance when the armature is in an opened position (i.e., at a minimum distance from the pole, when the solenoid is energized). The first reluctance and the second reluctance can be produced by any suitable aspect of the solenoid, such as, for example, air gaps within the flux path, intrinsic properties of the materials that define the flux path and the like. The second reluctance is within a range of between about seventy percent and 130 percent of the first reluctance. Similarly stated, the difference between the value of the first reluctance and the value of the second reluctance is less than about thirty percent of the value of the first reluctance.

In some embodiments, an apparatus includes a housing, a solenoid coil disposed within the housing, a pole member and an armature. The armature is configured to move from a first position to a second position when the solenoid coil is energized. A contact surface of the armature is spaced apart from a contact surface of the pole member by a first distance when the armature is in the first position. The contact surface of the armature is spaced apart from the contact surface of the pole member by a second distance when the armature is in the second position. The housing, the pole member and the armature collectively define a flux path characterized by a first reluctance when the armature is in the first position and a second reluctance when the armature is in the second position. The difference between the value of the first reluctance and the value of the second reluctance is less than about thirty percent of the value of the first reluctance.

In some embodiments, an electromagnetic solenoid assembly includes an armature and a pole member (or end-stop), and defines a first air gap and a second air gap. The first air gap is within a flux path of the solenoid assembly, and is defined by a distance between a first surface of the armature and a corresponding surface of the pole member. The second air gap is within the flux path of the solenoid assembly, and is defined by a distance between a second surface of the armature and a corresponding surface of a bobbin retainer. The first surface of the armature and the second surface of the armature are configured such that a total reluctance defined by the first air gap and the second air gap changes by less than seventy percent during operation of the solenoid assembly. In this manner, the magnetic force produced by the solenoid assembly, which is inversely proportional to the reluctance, can be controlled during operation of the solenoid assembly. In some embodiments, the geometry of the first air gap is configured to be controlled by adjusting a major cone diameter of the pole member or a minor cone diameter of the armature.

In some embodiments, an apparatus includes a housing, a solenoid coil disposed within the housing, a pole member, a retainer and an armature. The retainer is configured to retain the solenoid coil within the housing. The armature is configured to move from a first position to a second position when the solenoid coil is energized. A first surface of the armature is spaced apart from a contact surface of the pole member by a first air gap when the armature is in the first position. The first surface of the armature is in contact with the contact surface of the pole member when the armature is in the second position. A second surface of the armature spaced apart from a surface of the retainer portion by a second air gap. The housing, the pole member, the armature and the retainer collectively define a flux path including the first air gap and the second air gap. A portion of the first surface of the armature and a portion of the contact surface of the pole member define a first air gap area within the flux path. The pole and the armature are configured such that the first air gap area decreases as the armature moves from the first position to the second position.

In some embodiments, a method of operating a pump assembly includes energizing a solenoid coil of the pump assembly to move an armature, which is coupled to a pump element, from a first position to a second position within a solenoid housing. The housing, a pole member, the armature and a retainer collectively define a flux path. A first surface of the armature is spaced apart from a contact surface of a pole member by a first air gap when the armature is in the first position. The first surface of the armature is in contact with the contact surface of the pole member when the armature is in the second position. A second surface of the armature is spaced apart from a surface of the retainer portion by a second air gap. A portion of the first surface of the armature and a portion of the contact surface of the pole member define a first air gap area within the flux path. The pole and the armature are configured such that the first air gap area decreases as the armature moves from the first position to the second position. The method further includes deenergizing the solenoid to move the armature from the second position to the first position within the solenoid housing.

In some embodiments, a method of assembling a solenoid assembly includes coupling a retainer to a housing to retain a solenoid coil within the housing. A pole member is then disposed within the housing. The pole member includes a contact surface. The method further includes disposing an armature within the housing, the armature being configured to move from a first position to a second position when the solenoid coil is energized, the housing. The pole member, the retainer, and the armature collectively define a flux path characterized by a first reluctance when the armature is in the first position and a second reluctance when the armature is in the second position. The difference between the first reluctance and the second reluctance is less than about thirty percent of the value of the first reluctance.

As used in this specification, the singular forms "a," "an" and "the" include plural referents unless the context clearly dictates otherwise. Thus, for example, the term "a member" is intended to mean a single member or a combination of members, "a material" is intended to mean one or more materials, "a processor" is intended to mean a single processor or multiple processors; and "memory" is intended to mean one or more memories, or a combination thereof.

As used herein, the terms "about" and "approximately" generally mean plus or minus 10% of the value stated. For example, about 0.5 would include 0.45 and 0.55, about 10 would include 9 to 11, about 1000 would include 900 to 1100.

Figure 1B:
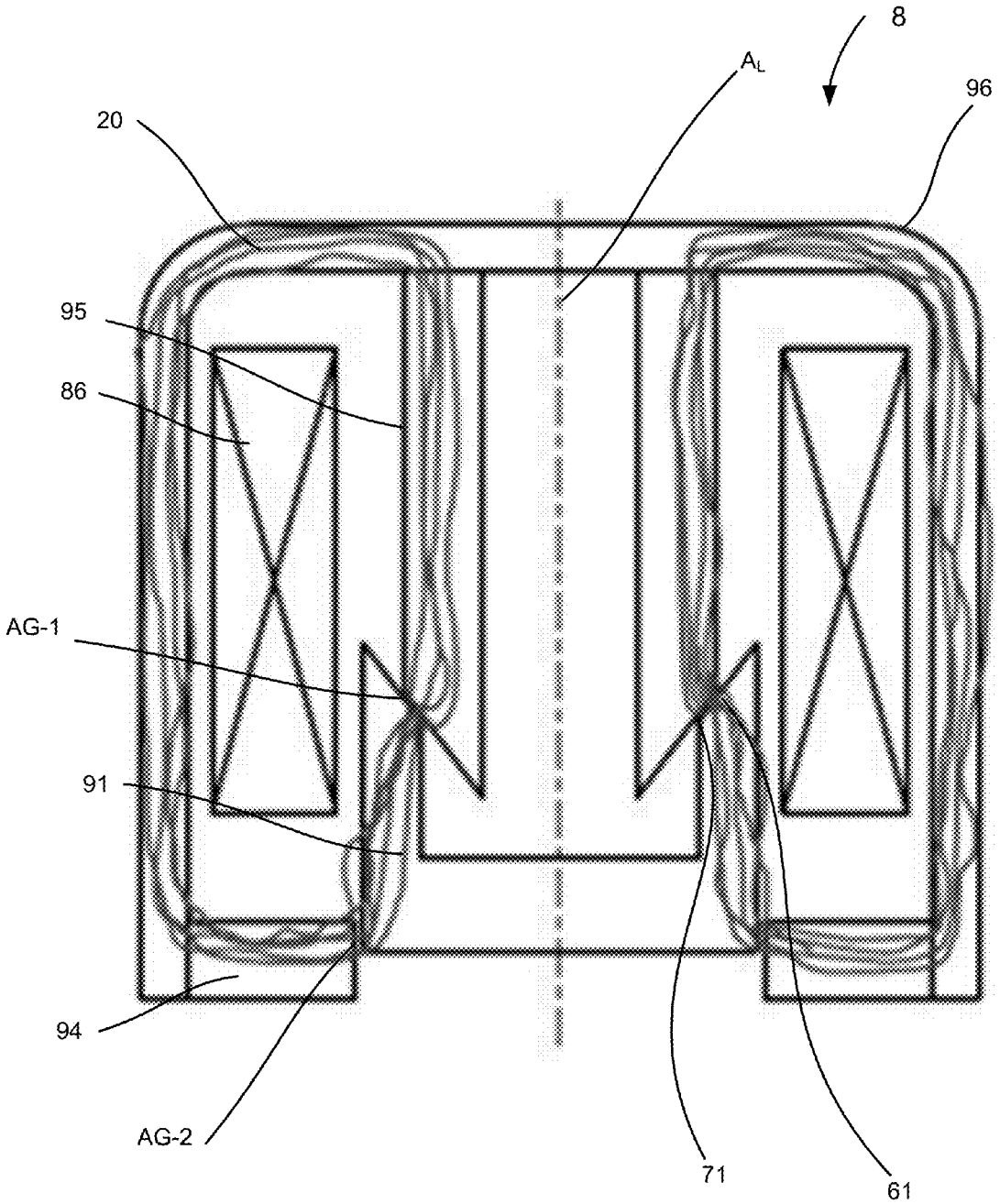

FIGS. 1A and 1B are schematic illustrations of a solenoid assembly 8, according to an embodiment. The solenoid assembly 8 can be used in any suitable solenoid-actuated device, such as, for example, pumps, valves, hydraulic systems or the like. The solenoid assembly 8 includes a housing 96, a solenoid coil 86, a retainer 94, an armature 91, and a pole 95. The armature 91 is disposed within the coil 86, and is configured to move between a first position (FIG. 1A) and a second position (FIG. 1B). In some embodiments, the armature 91 can be coupled to an actuator rod (not shown) such that movement of the armature results in movement of the actuator rod (to actuate a valve, pump or the like).

In particular, the solenoid 8 can be configured to move between a first configuration (when the solenoid coil 86 is not energized, see, e.g., FIG. 1A) and a second configuration (when the solenoid coil 86 is energized, see, e.g., FIG. 1B). During normal operation, a first air gap AG-1 is defined between the armature 91 and the pole 95, and a second air gap AG-2 is defined between the armature 91 and the retainer 94. Moreover, the solenoid assembly 8 defines a flux path 20 through which the magnetic field is generated when an electrical current passes through the solenoid coil 86. As shown, the flux path 20 is defined by portions of the pole 95, the armature 91, the retainer 94 and the housing 96. The flux path is characterized by a reluctance that is dominated by the first air gap AG-1 and the second air gap AG-2. Similarly stated the magnetic reluctance of the solenoid assembly is primarily a function of the reluctance of the first air gap AG-1 and the reluctance of the second air gap AG-2. The reluctance for each of the first air gap AG-1 and the second air gap AG-2 is given by the following equation:

$$R = \mu_0 \frac{\text{distance}}{\text{area}} \tag{1}$$

wherein R is the air gap reluctance, $\mu_0$ is permeability of air, distance is the distance across the air gap (i.e. the shortest distance between two opposing surfaces), and the area is the "air gap" area. Applying this formula to the first air gap AG-1 as shown in FIG. 1A, the distance d is the is the distance between a contact surface 61 of the armature and a contact surface 71 of the pole member (the contact surface are identified in FIG. 1B) along a line normal to the contact surface 61 and/or the contact surface 71. It should be noted that the distance through which the armature 91 moves along its axis of motion $A_L$ is referred to as the "stroke" (identified as ST in FIG. 1A). Thus, the larger the distance d (and the stroke ST), the larger the reluctance R. In some embodiments, the stroke ST can be the same as the distance d of the first air gap AG-1. For example, in such embodiments where the line normal to the contact surface 61 and/or the contact surface 71 is parallel to the axis of motion $A_L$, the stroke ST can be the same as the distance d of the first air gap AG-1. Here, where the contact surface 61 (or the contact surface 71) and the axis of motion $A_L$ define an acute angle, the distance d is less than the stroke ST. Similarly stated, where the contact surface 61 (or the contact surface 71) are tapered, the distance d is less than the stroke ST The "air gap" area is the area of the opposing surfaces through which the flux path of the magnetic field passes. Referring again to FIGS. 1A and 1B, the air gap area is the area defined by the portion of the contact surface 61 that is aligned with and/or opposes the corresponding portion of the contact surface 71 along the line normal to the contact surface 61 and/or the contact surface 71. As described in detail below, in some embodiments, the armature 91 and pole member 95 are configured such that the air gap area is changes (e.g., decreases) when the solenoid assembly 8 is actuated.

The solenoid assembly 8 is configured such that the flux path 20 is characterized by a first reluctance when the armature is in a closed position (i.e., at a maximum distance from the pole, when the solenoid is not energized, see FIG. 1A) and a second reluctance when the armature is in an opened position (i.e., at a minimum distance from the pole, when the solenoid is energized, see FIG. 1B). The solenoid assembly 8 is configured such that the second reluctance is within about seventy percent of the first reluctance. Similarly stated, the difference between the first reluctance and the second reluctance is less than about thirty percent of the value of the first reluctance. In some embodiments, the solenoid assembly 8 is configured such that the second reluctance is within a range of about fifty percent, about forty percent, about thirty percent, about twenty percent or about ten percent of the first reluctance. In some embodiments, the solenoid assembly 8 is configured such that the second reluctance about the same as first reluctance. In yet other embodiments, the solenoid assembly 8 is configured such that the second reluctance is within a range of one hundred percent to one percent of the first reluctance. The second reluctance can be either higher or lower than the first reluctance.

As shown in FIG. 1A, the first air gap AG-1 has a maximum distance d (or gap) and the surface area defining the first air gap (i.e., the "air gap area" defined by the opposing contact surface 61 and the contact surface 71) is at a maximum value when the solenoid 8 is in the first configuration. In contrast, as shown in FIG. 1B, the first air gap AG-1 is at a minimum (or substantially no) gap and the surface area defining the first air gap is at a minimum value when the solenoid 8 is in the second configuration. Thus, the reluctance of the first air gap AG-1 can be controlled during the stroke of the solenoid assembly 8 by configuring the armature 91 and/or the pole 95. Similarly stated, the change in the reluctance of the first air gap AG-1 as a function of the solenoid stroke can be controlled, managed and/or limited by controlling the area defined by the first surface of the armature 91 and the corresponding surface of the pole 95.

As shown in FIGS. 1A and 1B, the air gap area of the first air gap AG-1 can be controlled by adjusting the overlap of the major cone diameter (or outer diameter, identified as $OD_P$) on the pole 195 and the minor cone diameter (or inner diameter, identified as $ID_A$) on the armature 191. In particular, the outer diameter $OD_P$ defining the contact surface 71 of the pole 95 is between an outer diameter $OD_A$ defining the contact surface 61 of the armature 91 and the inner diameter $ID_A$ defining the contact surface 61 of the armature 91. Increasing this overlap (i.e., adjusting the components such that the outer diameter $OD_A$ is close in size to the outer diameter $OD_P$) will reduce the reluctance of the first air gap AG-1 by increasing the air gap area of the AG-1, leading to a higher magnetic force at the second configuration. Decreasing this overlap (i.e., adjusting the components such that the inner diameter $ID_A$ is close in size to the outer diameter $OD_P$) will increase the reluctance of the first air gap AG-1 by reducing the air gap area of the AG-1, leading to a lower magnetic force at the second configuration. Therefore, by adjusting the overlap of pole 95 and the armature 91, the reluctance of the first air gap AG-1 can be controlled leading to a controlled magnetic force during the operation of the solenoid assembly 8.

Further, as shown in FIGS. 1A and 1B, the second air gap AG-2 has a relatively constant distance during operation of the solenoid assembly 8 (i.e., the second air gap AG-2 is substantially parallel to the direction of motion of the armature 91, and thus does not change significantly with movement of the armature). The surface area defining the second air gap AG-2, however, changes during operation of the solenoid assembly 8 (the area is at a minimum value when the solenoid 8 is in the second configuration). Similarly stated, a sliding surface of the armature 91 and a corresponding surface of the retainer 94 are configured such that the second air gap area decreases as the armature moves from the first position to the second position. Thus, the reluctance of the second air gap AG-2 can be controlled during the stroke of the solenoid assembly 8 by configuring the armature 91 and/or the retainer 94.

Because the reluctance of each of the first air gap AG-1 and the second air gap AG-2 during operation of the solenoid assembly 8 can be controlled and/or maintained in accordance with a desired profile (i.e., of reluctance vs. stroke), the solenoid assembly 8 can be configured such that the overall reluctance as a function of stroke can be in accordance with a desired function. For example, in some embodiments, the solenoid assembly 8 is configured such that the second reluctance is substantially equal to the second reluctance. In other embodiments, the solenoid assembly 8 is configured such that the second reluctance is within about one hundred percent of the first reluctance. The second reluctance can be higher or lower than the first reluctance.

Figure 2:
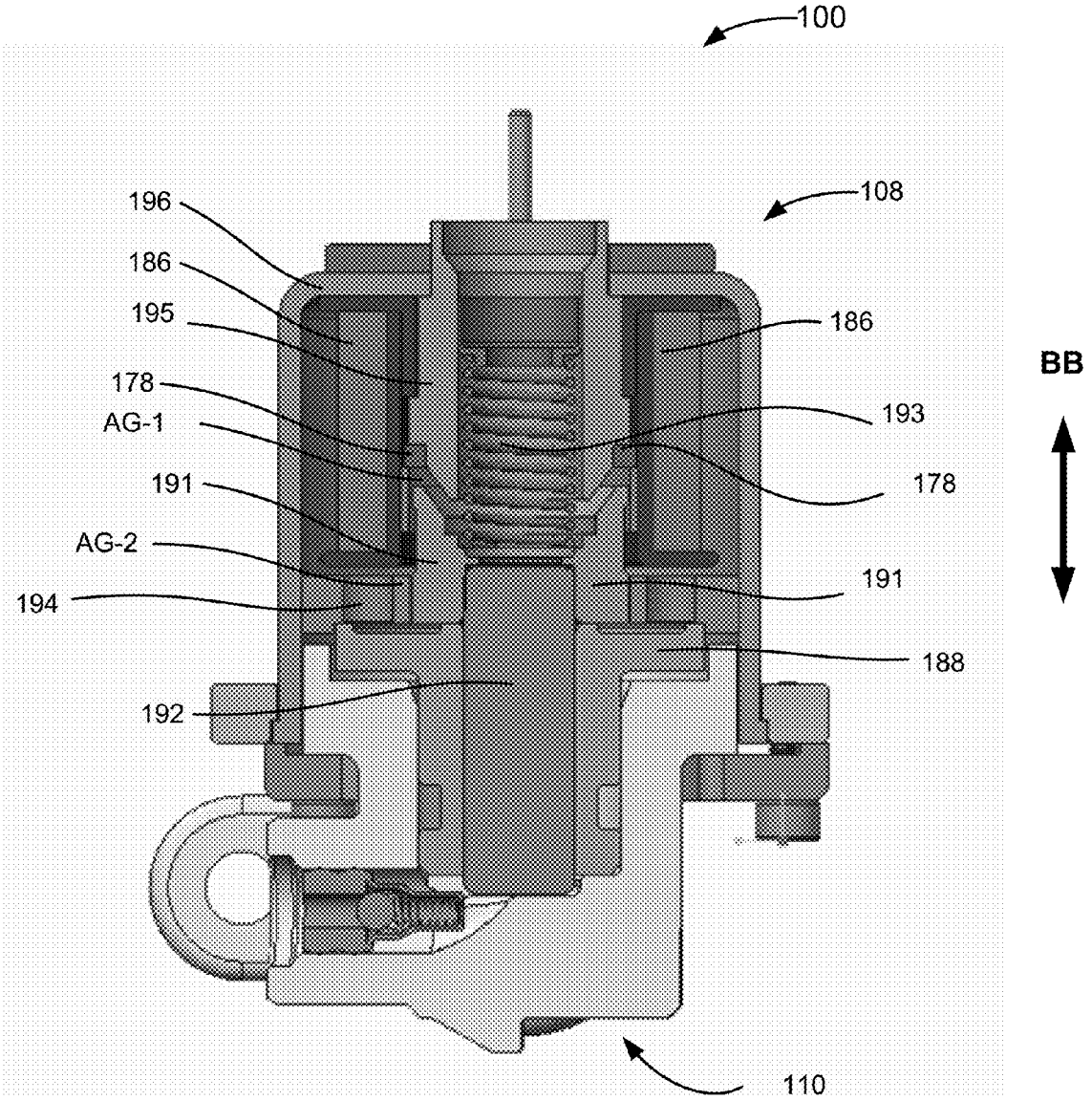
FIG. 2 is a cross-sectional view of a fluid transfer assembly, according to an embodiment.
Figure 3:
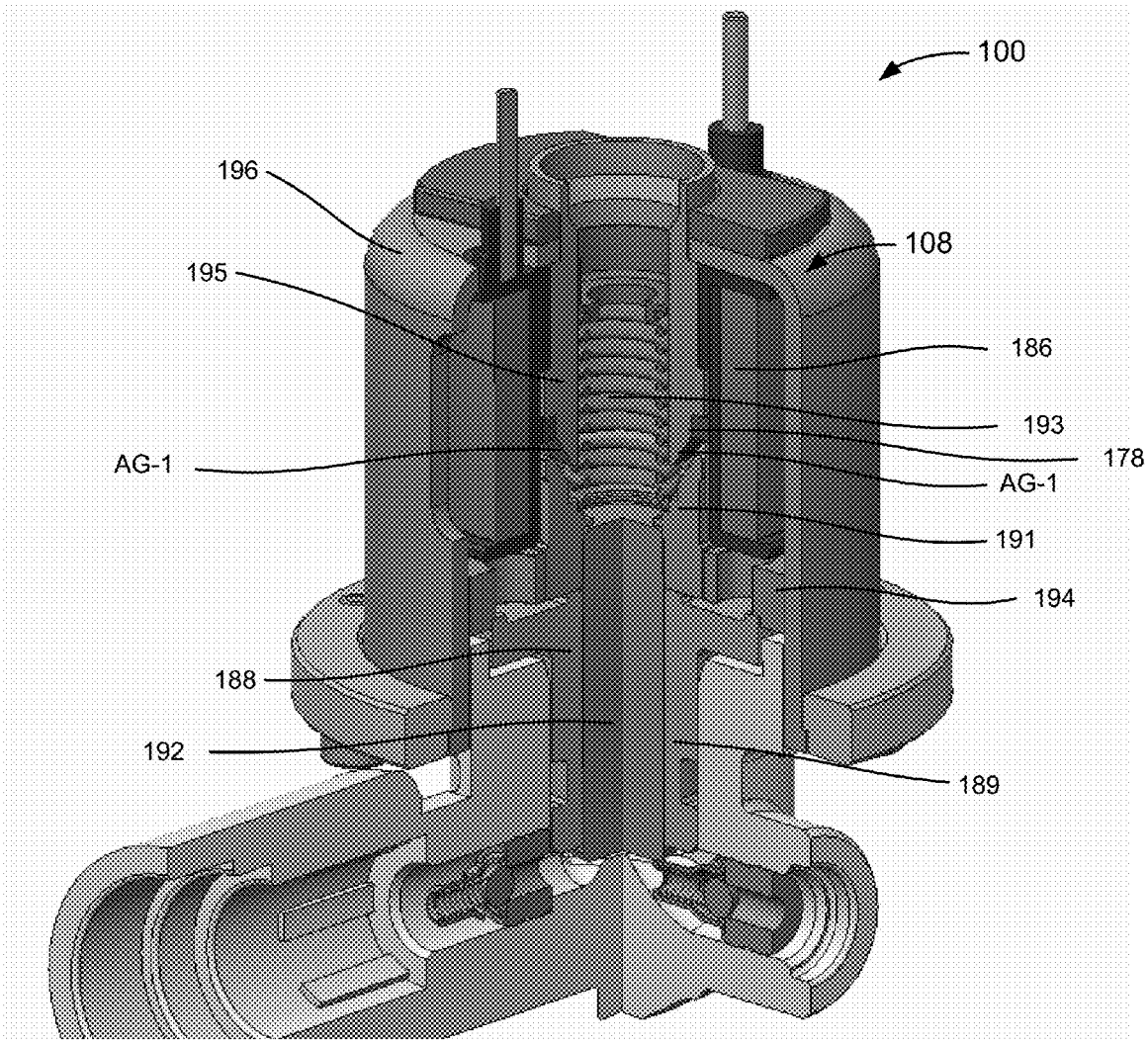
FIG. 3 is a partial cross-sectional view of the fluid transfer assembly, according to an embodiment.

In some embodiments, a solenoid assembly can be used in connection with a fluid transfer assembly, such as a solenoid pump. FIGS. 2-3 are cross-sectional views of a fluid transfer assembly 100, according to an embodiment. In some embodiments, the fluid transfer assembly can be, for example, an oil pump assembly. As shown in FIGS. 2 and 3, the fluid transfer assembly 100 includes a solenoid assembly 108, and a pump assembly 110. The solenoid pump 100 is configured to be coupled to a fluid reservoir (not shown) to transfer fluids from the fluid reservoir to, for example, an engine of a vehicle. The solenoid assembly 108 is configured to receive an electrical signal (e.g., from any suitable controller) to actuate and further cause the components of the pump assembly 110 to move in a reciprocating fashion. The solenoid assembly 108 includes a housing 196, a solenoid coil 186, a bobbin retainer 194, an armature 191, an actuator rod 192, a spring 193, a pole 195 and a lower plate 188 (also known as bushing). The actuator rod 192 and the lower plate 188 are configured such that the actuator rod 192 can freely move within and/or through the lower plate 188 when the solenoid assembly 108 is energized. The armature 191 is disposed within the coil 186. The actuator rod 192 is coupled to the armature 191 such that when the armature 191 is moved between a first position and a second position, the actuator rod 192 is moved between a first position and a second position. In some instances, the pole 195 can include shock absorbers 178 to prevent the armature 191 from directly crashing against the pole 195.

Figure 4B:
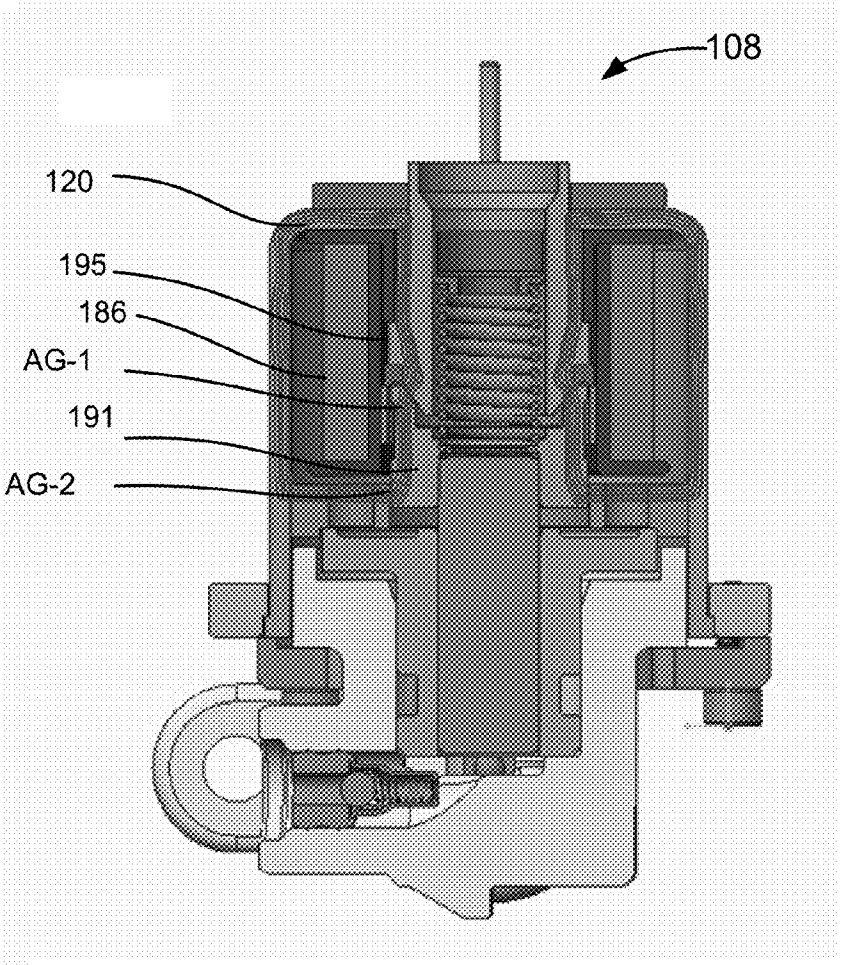
FIGS. 4A-4B are cross-sectional views of the electromagnetic solenoid assembly with magnetic field lines in the first and the second configurations, respectively, according to an embodiment.
Figure 4A:
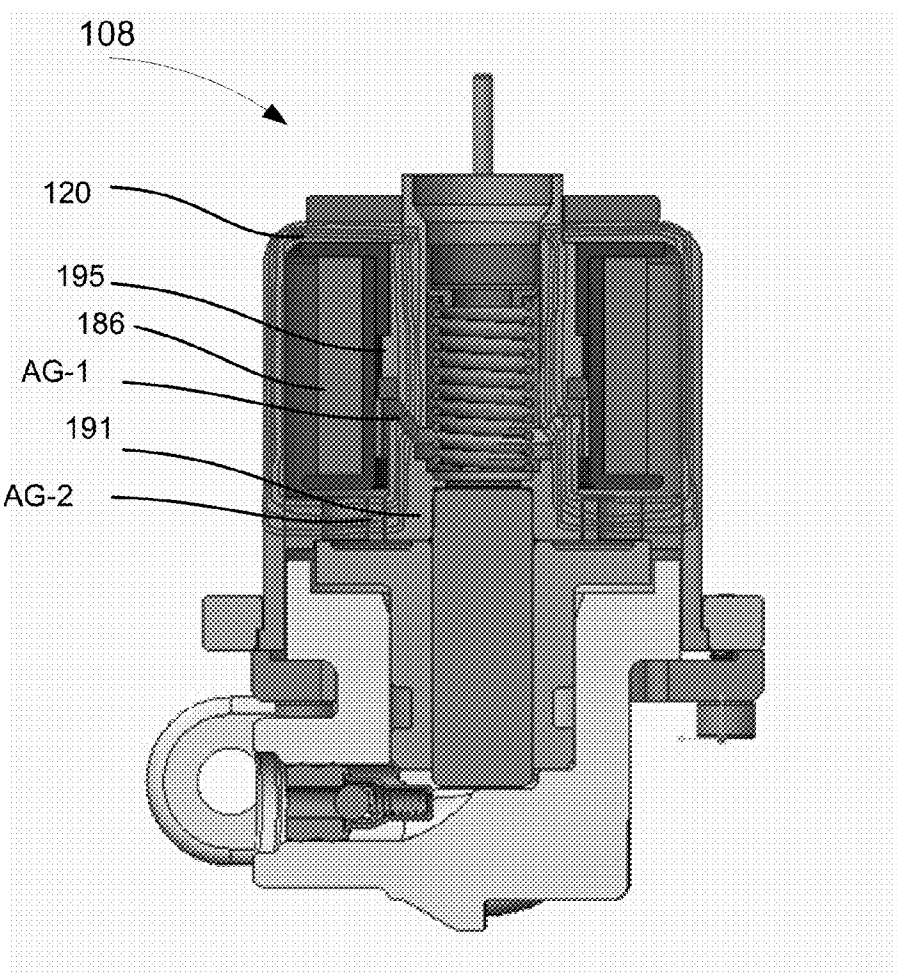
Figure 5B:
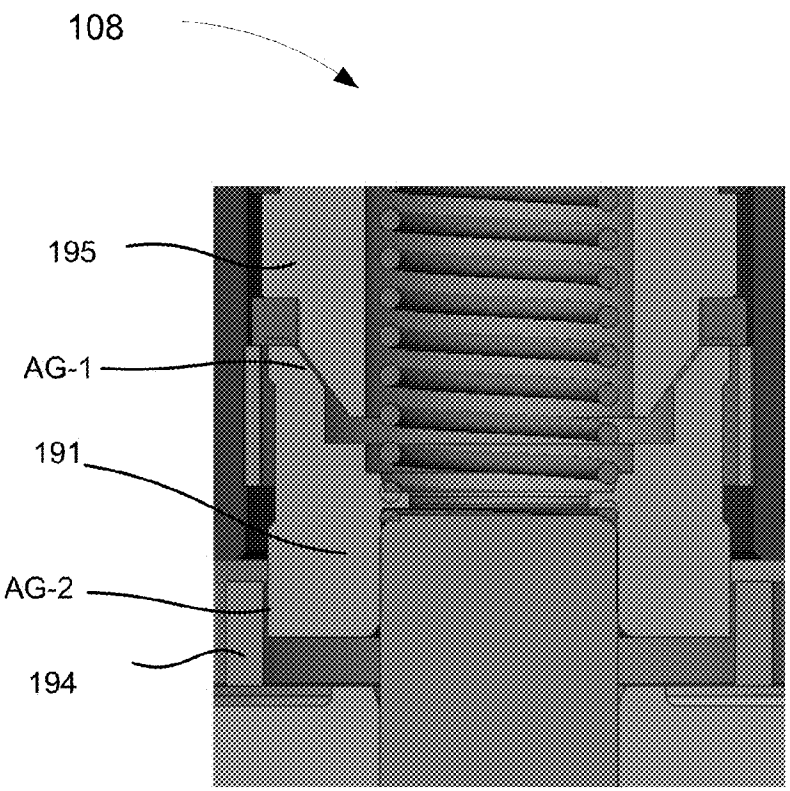
FIGS. 5A-5B are enlarged cross-sectional views of the electromagnetic solenoid assembly shown in FIGS. 4A-4B in the first and the second configurations, respectively, according to an embodiment.

The solenoid-actuated pump 100 can be configured to move between the first configuration (the "intake configuration" when the solenoid assembly 108 is not energized, see, e.g., FIGS. 4A, and 5A) and the second configuration (the "pumping configuration" when the solenoid assembly 108 is energized, see, e.g., FIGS. 4B, and 5B). During normal operation, a first air gap AG-1 (having a distance referred to as the "stroke") is defined between the armature 191 and the pole 195, and a second air gap AG-2 is defined between the armature 191 and the retainer 194. When the armature 191 moves from one end-stop (occurring when the solenoid assembly 108 is not energized) to the other end-stop (occurring when the solenoid assembly 108 is fully energized) as indicated by the arrow BB in FIG. 2, the armature 191 can be considered to travel a full stroke. Moreover, the solenoid assembly 108 defines a flux path through which the magnetic field is generated when an electrical current passes through the solenoid coil 186. As shown in FIGS. 4A and 4B, the lines 120 inside the solenoid assembly 108 represent the flux path of the magnetic field generated when an electrical current passes through the solenoid assembly 108. The flux path (which can be referred to as the dominant flux path) is defined by portions of the pole 195, the armature 191, the retainer 194 and the housing 196. The flux path is characterized by a reluctance that is dominated by the first air gap AG-1 and the second air gap AG-2. Similarly stated the magnetic reluctance of the solenoid assembly is primarily a function of the reluctance of the first air gap AG-1 and the reluctance of the second air gap AG-2. The reluctance for each of the first air gap AG-1 and the second air gap AG-2 is given by Equation (1). Moreover, the discussion of the air gap distance and stroke, as well as the discussion of the air gap area with reference to the solenoid assembly 8 are applicable to the solenoid assembly 108.

Figure 5A:
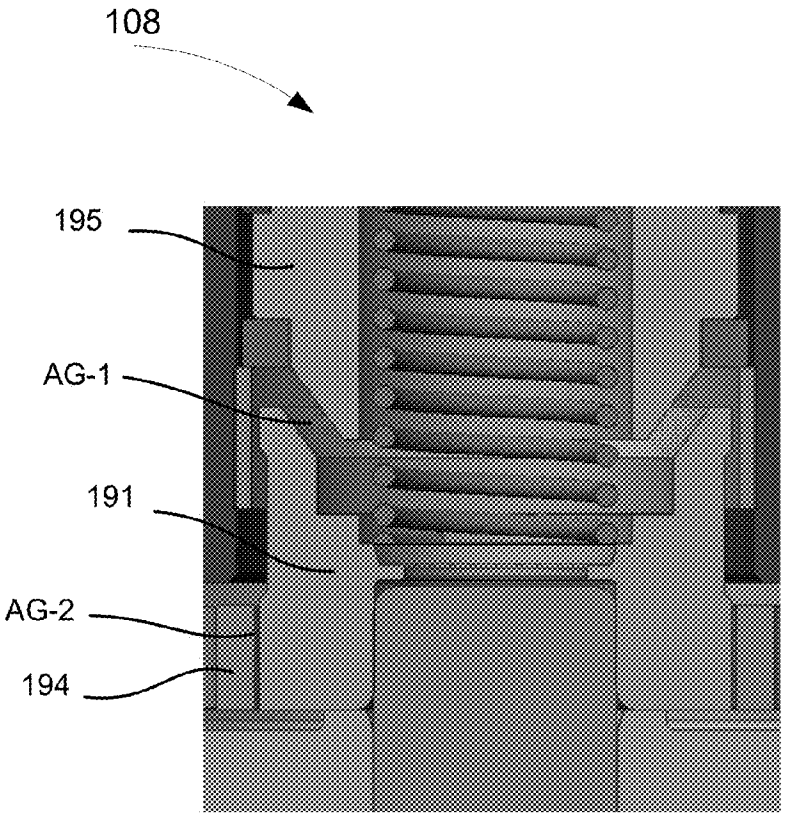

The solenoid assembly 108 is configured such that the flux path is characterized by a first reluctance when the armature is in a closed position (i.e., at a maximum distance from the pole, when the solenoid is not energized, see FIGS. 4A and 5A) and a second reluctance when the armature is in an opened position (i.e., at a minimum distance from the pole, when the solenoid is energized, see FIGS. 4B and 5B). The solenoid assembly 108 is configured such that the second reluctance is within about seventy percent of the first reluctance. In some embodiments, the solenoid assembly 108 is configured such that the second reluctance is within a range of about fifty percent, about forty percent, about thirty percent, about twenty percent or about ten percent of the first reluctance. In some embodiments, the solenoid assembly 108 is configured such that the second reluctance about the same as first reluctance. In yet other embodiments, the solenoid assembly 108 is configured such that the second reluctance is within a range of one hundred percent to one percent of the first reluctance. The second reluctance can be either higher or lower than the first reluctance As shown in FIGS. 4A and 5A, the first air gap AG-1 is at a maximum gap and the surface area defining the first air gap (i.e., the opposing surfaces of the armature 191 and the pole 195) is at a maximum value when the solenoid 108 is in the first configuration. In contrast, as shown in FIGS. 4B and 5B, the first air gap AG-1 is at a minimum (or substantially no) gap and the surface area defining the first air gap is at a minimum value when the solenoid 108 is in the second configuration. Thus, the reluctance of the first air gap AG-1 can be controlled during the stroke of the solenoid assembly 108 by configuring the armature 191 and/or the pole 195. Similarly stated, the change in the reluctance of the first air gap AG-1 as a function of the solenoid stroke can be controlled, managed and/or limited by controlling the area defined by the first surface of the armature 191 and the corresponding surface of the pole 195. Further, as shown in FIGS. 5A and 5B, the second air gap AG-2 has a relatively constant distance during operation of the solenoid assembly 108 (i.e., the second air gap AG-2 is substantially parallel to the direction of motion of the armature 191, and thus does not change significantly with movement of the armature). The surface area defining the second air gap AG-2, however changes during operation of the solenoid assembly 108 (the area is at a minimum value when the solenoid 108 is in the second configuration). Thus, the reluctance of the second air gap AG-2 can be controlled during the stroke of the solenoid assembly 108 by configuring the armature 191 and/or the retainer 194.

Because the reluctance of each of the first air gap AG-1 and the second air gap AG-2 during operation of the solenoid assembly 108 can be controlled and/or maintained in accordance with a desired profile (i.e., of reluctance vs. stroke), the solenoid assembly 108 can be configured such that the overall reluctance as a function of stroke can be in accordance with a desired function. For example, in some embodiments, the solenoid assembly 108 is configured such that the second reluctance is substantially equal to the second reluctance. The solenoid assembly 8 is configured such that the second reluctance is within about seventy percent of the first reluctance. In some embodiments, the solenoid assembly 108 is configured such that the second reluctance is within a range of one hundred percent to one percent of the first reluctance. The second reluctance can be higher or lower than the first reluctance.

When the sum of the first and the second air gap reluctances at the first and the second configurations is controlled, the inductance of the solenoid assembly 108 is controlled when the armature 191 moves, thus leading to a controlled magnetic field with respect to the electrical current in the coil 186. Similarly stated, the magnetic force of the solenoid assembly 108 is controlled by configuring the solenoid assembly 108 such that the first air gap reluctance and the second air gap reluctance change in accordance to a desired profile when the armature 191 moves from one end-stop to the other end-stop (pole 195). If the sum of the first and the second air gap reluctances at the first and the second configurations are equal, the magnetic force will remain constant with respect to the current in the coil 186. In some embodiments, some solenoid pump applications can benefit from a substantially constant magnetic force at various armature positions. In other embodiments, the sum of the first and the second air gap reluctances between the first and the second configurations can be any ratio for various different solenoid applications.

As the armature moves from the first configuration (when the solenoid assembly 108 is not energized, see, e.g., FIGS. 4A, and SA) to the second configuration (when the solenoid assembly 108 is energized, see, e.g., FIGS. 4B, and 5B), the air gap distance of the second air gap AG-2 remains the same while the air gap area of AG-2 (i.e., the opposing surfaces of the armature 191 and the retainer 194) is reduced. As previously discussed with regards to FIGS. 1A-1B, the retainer 194 is configured to retain the solenoid 108 within the housing. A portion of the armature 191 is configured to move within the retainer 194. A surface of the portion of the armature 191 (i.e., sliding surface) and a surface of the retainer define an air gap area of AG-2 within the flux path. This results in an increased reluctance of the second air gap AG-2. The red shading in FIGS. 5A and 5B represents the dominant flux path of the magnetic field of the solenoid assembly 108. The area of the dominant flux path of the magnetic field of the second air gap AG-2 is reduced as the armature moves from the first configuration (e.g., FIG. SA) to the second configuration (e.g., FIG. 5B).

As the armature moves from the first configuration (when the solenoid assembly 108 is not energized, see, e.g., FIGS. 4A, and SA) to the second configuration (when the solenoid assembly 108 is energized, see, e.g., FIGS. 4B, and 5B), the air gap distance of the first air gap AG-1 is reduced and the air gap area of AG-1 (i.e., the area of opposing surfaces of the armature 191 and the pole 195 along a line normal to the two surfaces, and not necessarily along the axis of motion of the armature) is also reduced. The red shading in FIGS. 5A and 5B represents the dominant flux path of the magnetic field of the solenoid assembly 108. The distance of the dominant flux path of the magnetic field of the first air gap AG-1 is reduced as the armature moves from the first configuration (e.g., FIG. SA) to the second configuration (e.g., FIG. 5B), and the air gap area of the AG-1 is also reduced.

As discussed above with respect to the solenoid assembly 8, the air gap area of the first air gap AG-1 can be controlled by adjusting the overlap of the major cone diameter (or outer diameter) on the pole 195 and the minor cone diameter (or inner diameter) on the armature 191. An outer diameter defining the contact surface of the pole 195 is between an outer diameter defining the contact surface of the armature 191 and an inner diameter defining the contact surface of the armature 191. Increasing this overlap will reduce the reluctance of the first air gap AG-1 by increasing the air gap area of the AG-1, leading to a higher magnetic force at the second configuration. Decreasing this overlap will increase the reluctance of the first air gap AG-1 by reducing the air gap area of the AG-1, leading to a lower magnetic force at the second configuration. Therefore, by adjusting the overlap of pole 195 and the armature 191, the reluctance of the first air gap AG-1 can be controlled leading to a controlled magnetic force during the operation of the solenoid assembly 108.

In some embodiments, as discussed above, the reluctance of the first air gap is reduced when the armature moves from the first configuration to the second configuration. Given that the reluctance of the second air gap is increased when the armature moves from the first configuration to the second configuration, the sum of the first air gap reluctance and the second air gap reluctance can be configured to remain constant, leading to a constant magnetic force. In other embodiments, the sum of the first air gap reluctance and the second air gap reluctance can change by a desired amount to produce the desired force profile.

In some embodiments, the overlap of the major cone diameter (or outer diameter) of the pole 195 and the minor cone diameter (or inner diameter) of the armature 191 can be selected to produce the desired magnetic force behavior for different solenoid applications (i.e., to achieve a desired profile of reluctance as a function of stroke). The major cone diameter of the pole 195 can be configured to be greater, equal to, or smaller than the minor cone diameter of the armature 191. In circumstances when the major cone diameter of the pole 195 is configured to be smaller than the minor cone diameter of the armature 191, the reluctance of the first air gap AG-1 changes significantly and the magnetic force vector changes direction, which can lead to a near zero magnetic force condition at certain armature positions. In some embodiments, the major cone diameter of the pole 195 is greater than the minor cone diameter of the armature 191 and the overlap is about 1 mm.

As discussed earlier, the reluctance of the air gap depends on the air gap distance and the air gap area based on Equation (1). The distance of the second air gap AG-2 remains the same as the armature moves from one end-stop to the other end-stop while the area of the second air gap AG-2 is reduced, as shown in FIGS. 5A and 5B. The area of the second air gap AG-2 depends on the stroke of the solenoid assembly 108 (or the distance between one end-stop and the other end-stop) and the length over which the second surface of the armature 191 and the corresponding opposing surface of the retainer 194 are aligned to define a portion of the flux path 120. The length of alignment of the armature 191 to the dominant flux of the magnetic field is determined by the thickness of the bobbin retainer 194 and/or the thickness of the lower portion of the armature 191. The ratio of the stroke of the solenoid assembly 108 and the length of this alignment can be varied based on different solenoid applications. FIG. 5A and FIG. 5B show an embodiment where the stroke of the solenoid assembly 108 is approximately 50% of the length of alignment. In some embodiments, the stroke of the solenoid assembly 108 can be configured to be greater than the length of alignment which leads to a reduction of the magnetic force.

In some embodiments, the electromagnetic solenoids described herein are designed to have a ratio of the total reluctance of the first and the second air gaps at the second configuration (i.e., when the solenoid assembly 108 is energized) to the total reluctance of the first and the second air gaps at the first configuration (i.e., when the solenoid assembly 108 is not energized) of about 1:1.5. In other embodiments, the ratio of the total reluctance of the first and the second air gaps at the second configuration to the total reluctance of the first and the second air gaps at the first configuration can be any ratio in the range of between about 1:10 and about 10:1.

In some embodiments, the design and construction of the electromagnetic solenoids described herein can be used in any solenoid assembly system with different geometries. In some embodiments, the direction and the angle of the cone between the armature 191 and the pole 195 (or first air gap AG-1) can be different. In some embodiments, the first air gap AG-1 can be substantially normal with respect to the axis of motion of the armature (i.e., need not be tapered). In some embodiments, the second air gap AG-2 can be modified to a conical or a stepped shape.

In some embodiments, the electromagnetic solenoids described herein can incorporate a tapered pole 195 and/or a tapered armature 191 to have a first air gap AG-1 and a second air gap AG-2. In some embodiments, the electromagnetic solenoids described herein can be cylindrical solenoids.

In some embodiments, other effects such as eddy currents, fluid damping, spring load change, and/or friction may be taken into account when designing the electromagnetic solenoids described herein.

Figure 6:
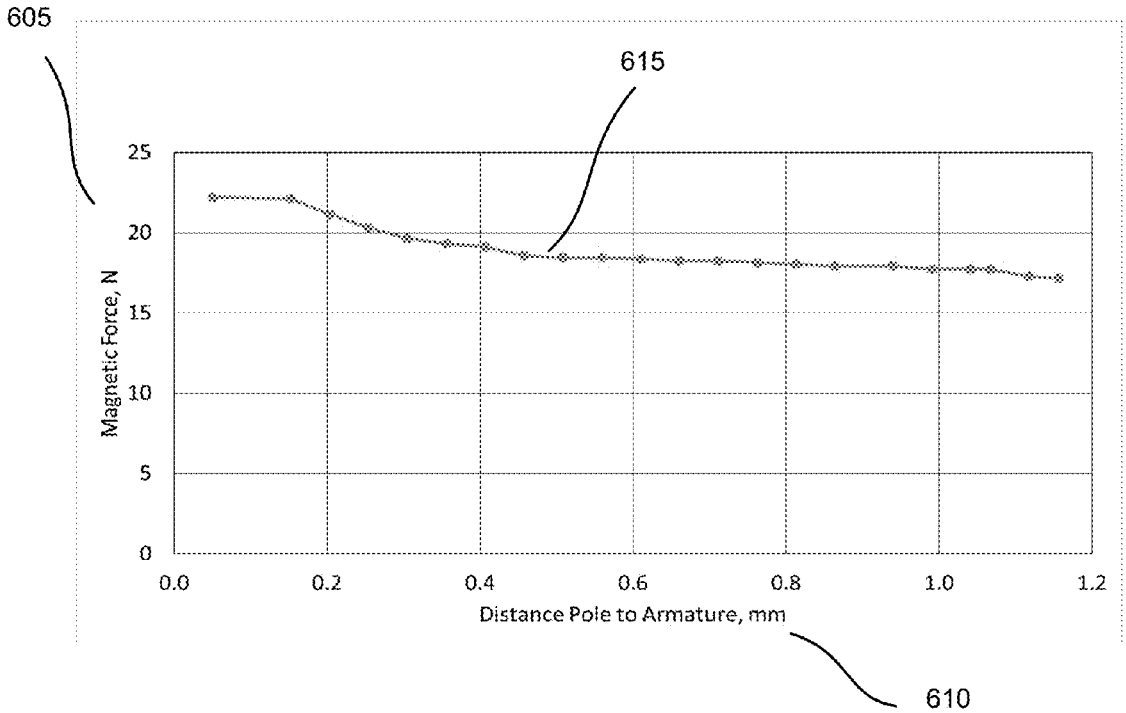
FIG. 6 is a graph showing a near constant magnetic force measured as the electromagnetic solenoid assembly operates between the first and the second configurations, according to an embodiment.

To further demonstrate the design and construction described herein, FIG. 6 shows a graph showing magnetic forces measured at various distances between the armature 191 and the pole 195 of a solenoid assembly 108. Although the plot in FIG. 6 is described with respect to the solenoid pump 108, it should be understood that this plot is for example only, and that the design and construction described herein can be applied to any suitable system containing a solenoid where the controlling of the reluctance would be helpful.

As shown in FIG. 6, the horizontal axis 610 represents the distance from the pole 195 to the armature 191 of the solenoid assembly 108. The vertical axis 605 represents the magnetic force measured at various distances. The plot 615 shows how the magnetic force changes as the distance from pole 195 to the armature 191 increases from approximately zero to approximately 1.2 mm. The plot shows a substantially constant magnetic force as the electromagnetic solenoid assembly operates between the first and the second configurations. More particularly, the value of the magnetic force when the solenoid assembly is opened is approximately 17.5 N and the value of the magnetic force when the solenoid is closed is approximately 22.5 N. Thus, the change in the value of the magnetic force from opened to closed is approximately 28 percent.

Figure 7:
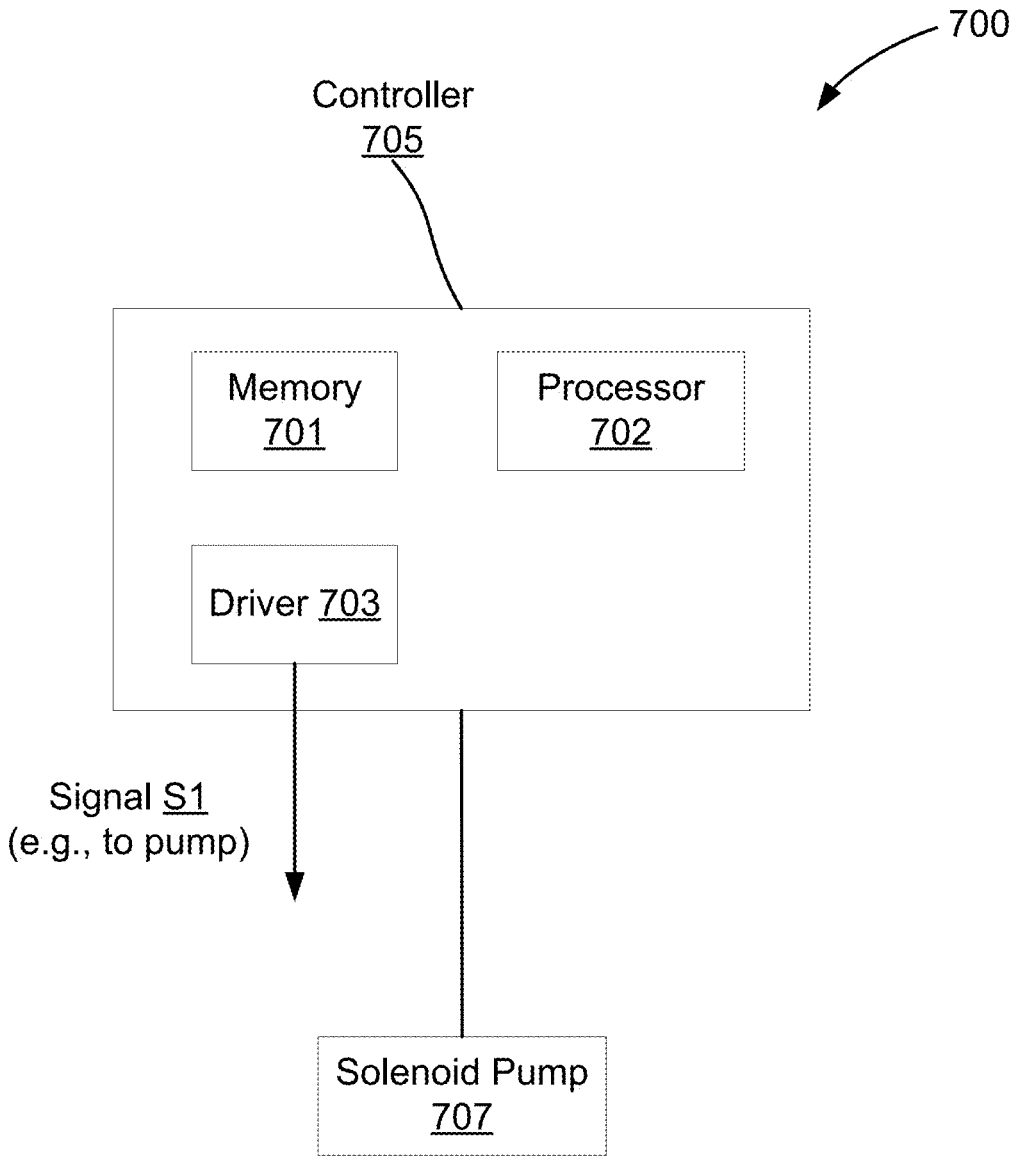
FIG. 7 is a schematic illustration of a fluid transfer system, according to an embodiment.

FIG. 7 is a schematic illustration of a fluid transfer system 700 according to an embodiment. The fluid transfer system 700 can be any suitable system including an electromagnetic solenoid for transferring and/or pumping fluids, and can be used in conjunction with any suitable equipment. In some embodiments, the fluid transfer system 700 can be any suitable system for transferring and/or pumping fluids in conjunction with vehicles or the like (e.g., a recreational vehicle, all-terrain vehicle (ATV), snowmobile, dirt bike, watercraft, on-highway vehicles, off-highway construction vehicles, or the like). In some embodiments, the fluid transfer system 700 can be used as an oil pump to transfer oil to an engine included in the vehicle.

As shown in FIG. 7, the fluid transfer system 700 includes a controller 705 and a solenoid-actuated pump 707. The solenoid-actuated pump 707 can be any suitable assembly, such as those shown and described herein. FIGS. 2-5B show examples of reciprocating, solenoid-actuated pumps that can be used in conjunction with the system 700.

The controller 705 can be any suitable controller, such as a vehicle control module, an engine control module or the like. The controller 705 can include a memory 701, a processor 702, and a driver module 703.

The processor 702 can be any processor configured to, for example, write data into and read data from the memory 701, and execute the instructions and/or methods stored within the memory 701. Furthermore, the processor 702 can be configured to control operation of the driver module 703, and/or components of the controller 705. Specifically, in some embodiments, the processor 702 can receive a signal associated with location or position of the armature relative to the pole member, and determine an approximate reluctance and/or magnetic force produced based on the distance between the armature and pole member. With this information, the processor can adjust the commands to the driver module 703, thereby adjusting the driver current based on the reluctance of the solenoid pump 707. In other embodiments, the processor 702 can be, for example, an application-specific integrated circuit (ASIC) or a combination of ASICs, which are designed to perform one or more specific functions. In yet other embodiments, the microprocessor can be an analog or digital circuit, or a combination of multiple circuits.

The memory device 701 can be any suitable device such as, for example, a read only memory (ROM) component, a random access memory (RAM) component, electronically programmable read only memory (EPROM), erasable electronically programmable read only memory (EEPROM), registers, cache memory, and/or flash memory.

The driver module 703 includes circuitry and/or components to produce a voltage potential and/or current specific a particular solenoid. For example, in some embodiments, the driver module 703 can be configured to produce a substantially constant current to the solenoid pump 707 during the pulse width when the solenoid pump is configured to have a substantially constant reluctance as a function of the solenoid stroke. In other embodiments, the driver module 703 can be configured to produce an initial peak current followed by a lower "hold" current during the pulse width when the solenoid pump is configured to have a reluctance that decreases as a function of the solenoid stroke.

Figure 8:
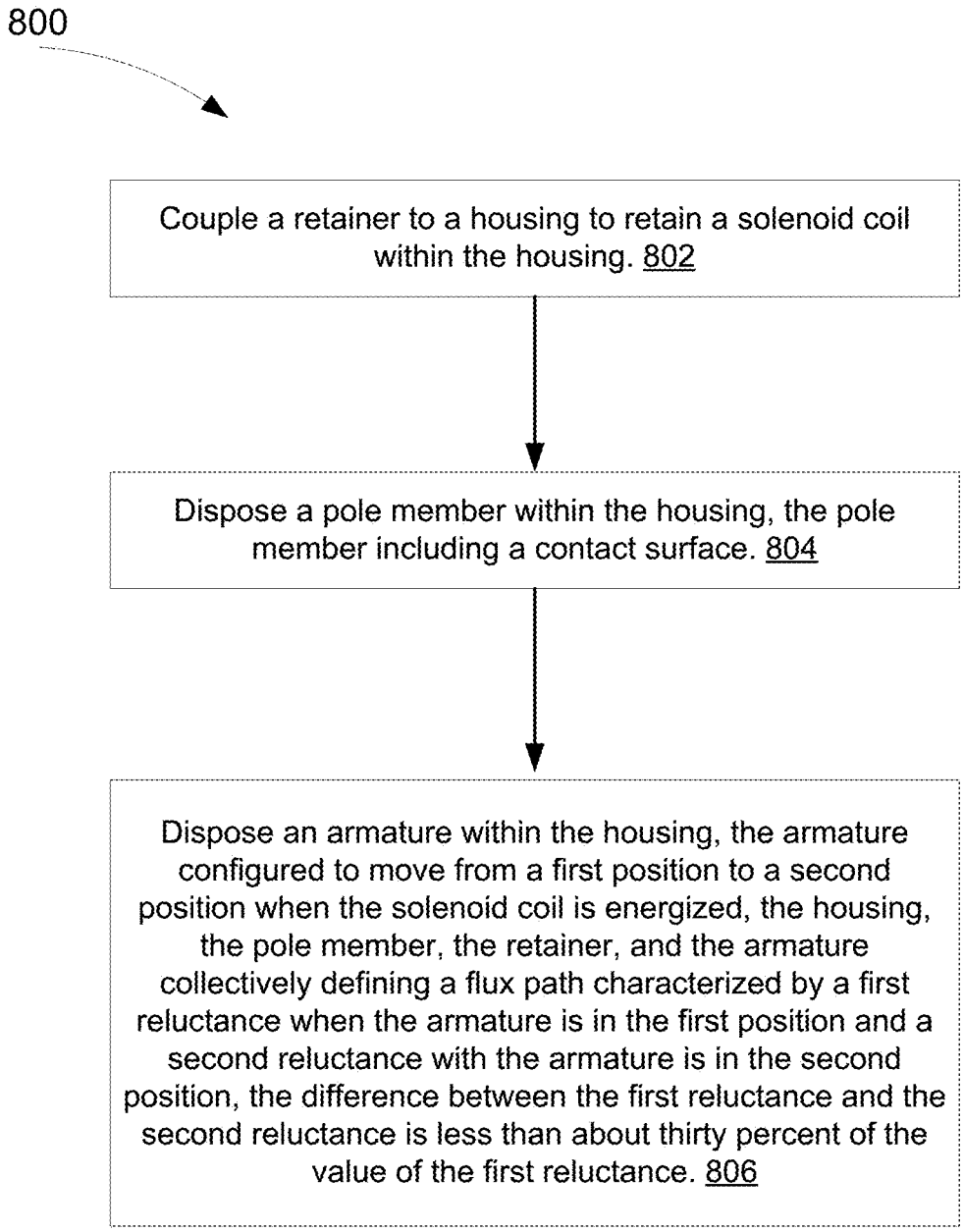
FIG. 8 is a flow chart illustrating a method of assembling an electromagnetic solenoid assembly having controlled reluctance.

FIG. 8 is a flow chart illustrating a method 800 of assembling an electromagnetic solenoid assembly having controlled reluctance according to an embodiment. The method 800 includes coupling a retainer to a housing to retain a solenoid coil within the housing, as described herein, at 802. The method 800 further includes disposing a pole member within the housing, at 804. The pole member can be any of the pole members described herein, and includes a contact surface. As described above, in some embodiments, the contact surface of the pole member can be tapered. Similarly stated, in some embodiments, the contact surface of the pole member and an axis along which an armature moves can define an acute angle.

The method 800 further includes disposing an armature within the housing, at 806. The armature is configured to move from a first position to a second position when the solenoid coil is energized. The housing, the pole member, the retainer, and the armature collectively define a flux path characterized by a first reluctance when the armature is in the first position and a second reluctance when the armature is in the second position. The difference between the first reluctance and the second reluctance is less than about thirty percent of the value of the first reluctance.

Some embodiments described herein relate to a computer storage product with a non-transitory computer-readable medium (also can be referred to as a non-transitory processor-readable medium) having instructions or computer code thereon for performing various computer-implemented operations. The computer-readable medium (or processor-readable medium) is non-transitory in the sense that it does not include transitory propagating signals per se (e.g., a propagating electromagnetic wave carrying information on a transmission medium such as space or a cable). The media and computer code (also can be referred to as code) may be those designed and constructed for the specific purpose or purposes. Examples of non-transitory computer-readable media include, but are not limited to: magnetic storage media such as hard disks, floppy disks, and magnetic tape; optical storage media such as Compact Disc/Digital Video Discs (CD/DVDs), Compact Disc-Read Only Memories (CD-ROMs), and holographic devices; magneto-optical storage media such as optical disks; carrier wave signal processing modules; and hardware devices that are specially configured to store and execute program code, such as Application-Specific Integrated Circuits (ASICs), Programmable Logic Devices (PLDs), Read-Only Memory (ROM) and Random-Access Memory (RAM) devices.

Examples of computer code include, but are not limited to, micro-code or micro-instructions, machine instructions, such as produced by a compiler, code used to produce a web service, and files containing higher-level instructions that are executed by a computer using an interpreter. For example, embodiments may be implemented using imperative programming languages (e.g., C, Fortran, etc.), functional programming languages (Haskell, Erlang, etc.), logical programming languages (e.g., Prolog), object-oriented programming languages (e.g., Java, C++, etc.) or other suitable programming languages and/or development tools. Additional examples of computer code include, but are not limited to, control signals, encrypted code, and compressed code While various embodiments have been described above, it should be understood that they have been presented by way of example only, and not limitation. Where methods and/or schematics described above indicate certain events and/or flow patterns occurring in certain order, the ordering of certain events and/or flow patterns may be modified. Additionally certain events may be performed concurrently in parallel processes when possible, as well as performed sequentially. While the embodiments have been particularly shown and described, it will be understood that various changes in form and details may be made.

Where schematics and/or embodiments described above indicate certain components arranged in certain orientations or positions, the arrangement of components may be modified. Similarly, where methods and/or events described above indicate certain events and/or procedures occurring in certain order, the ordering of certain events and/or procedures may be modified.

Although various embodiments have been described as having particular features and/or combinations of components, other embodiments are possible having a combination of any features and/or components from any of embodiments as discussed above.

What is claimed is:

1. An apparatus, comprising:

a housing;

a solenoid coil disposed within the housing;

a pole member; and an armature configured to move from a first position to a second position when the solenoid coil is energized, a contact surface of the armature spaced apart from a contact surface of the pole member by a first distance when the armature is in the first position, the contact surface of the armature spaced apart from the contact surface of the pole member by a second distance when the armature is in the second position, the contact surface of the pole member defining an outer diameter that is between an outer diameter defining the contact surface of the armature and an inner diameter defining the contact surface of the armature, the housing, the pole member and the armature collectively defining a flux path characterized by a first reluctance when the armature is in the first position and a second reluctance when the armature is in the second position, the difference between the first reluctance and the second reluctance is less than about thirty percent of the value of the first reluctance.

2. The apparatus of claim 1, wherein the contact surface of the armature is tapered.

3. The apparatus of claim 1, wherein the contact surface of the armature and an axis along which the armature moves define an acute angle.

4. The apparatus of claim 1, wherein a portion of the contact surface of the armature and a portion of the contact surface of the pole member define an air gap area within the flux path, the pole member and the armature configured such that the air gap area decreases as the armature moves from the first position to the second position.

5. The apparatus of claim 1, further comprising:

a retainer configured to retain the solenoid within the housing, a portion of the armature configured to move within the retainer, the portion of the armature and the retainer being included in the flux path.

6. The apparatus of claim 5, wherein:

the portion of the armature includes a sliding surface; and the retainer includes a surface, the sliding surface of the armature and the surface of the retainer define an air gap area within the flux path, the retainer and the armature configured such that the air gap area decreases as the armature moves from the first position to the second position.

7. The apparatus of claim 1, further comprising:

a retainer configured to retain the solenoid within the housing, a portion of the contact surface of the armature and a portion of the contact surface of the pole member define a first air gap area within the flux path, the pole member and the armature configured such that the first air gap area decreases as the armature moves from the first position to the second position, a sliding surface of the armature configured to move within the retainer, the sliding surface and a surface of the retainer define a second air gap area within the flux path, the retainer and the armature configured such that the second air gap area decreases as the armature moves from the first position to the second position.

8. An apparatus, comprising:

a housing;

a solenoid coil disposed within the housing;

a pole member;

a retainer configured to retain the solenoid coil within the housing; and an armature configured to move from a first position to a second position when the solenoid coil is energized, a first surface of the armature spaced apart from a contact surface of the pole member by a first air gap when the armature is in the first position, the first surface of the armature in contact with the contact surface of the pole member when the armature is in the second position, a second surface of the armature spaced apart from a surface of the retainer portion by a second air gap, an outer diameter defining the contact surface of the pole member is between an outer diameter defining the first surface of the armature and an inner diameter defining the first surface of the armature, the housing, the pole member, the armature and the retainer collectively defining a flux path including the first air gap and the second air gap, a portion of the first surface of the armature and a portion of the contact surface of the pole member defining a first air gap area within the flux path, the pole member and the armature configured such that the first air gap area decreases as the armature moves from the first position to the second position.

9. The apparatus of claim 8, wherein the flux path is characterized by a first reluctance when the armature is in the first position and a second reluctance when the armature is in the second position, the difference between the first reluctance and the second reluctance is less than about thirty percent of the value of the first reluctance.

10. The apparatus of claim 8, wherein the second reluctance is within a range of about seventy percent, fifty percent, about forty percent, about thirty percent, about twenty percent or about ten percent of the first reluctance.

11. The apparatus of claim 8, wherein the second surface of the armature is configured to move within the retainer.

12. The apparatus of claim 8, wherein the second surface of the armature and the surface of the retainer define a second air gap area, the retainer and the armature are configured such that the second air gap area decreases as the armature moves from the first position to the second position.

13. The apparatus of claim 8, wherein:

a reluctance of the first air gap is reduced when the armature moves from the first position to the second position; and a reluctance of the second air gap is increased when the armature moves from the first position to the second position.

14. A method, comprising:

coupling a retainer to a housing to retain a solenoid coil within the housing;

disposing a pole member within the housing, the pole member including a contact surface defined by an outer diameter;

disposing an armature within the housing, the armature configured to move from a first position to a second position when the solenoid coil is energized, a first surface of the armature is spaced apart from the contact surface of the pole member in the first position, where the outer diameter of the pole member is between an outer diameter defining a contact surface of the armature and an inner diameter defining the contact surface of the armature, the housing, the pole member, the retainer, and the armature collectively defining a flux path having a first reluctance when the armature is in the first position and a second reluctance when the armature is in the second position, the difference between the first reluctance and the second reluctance is less than about thirty percent of the value of the first reluctance.

15. The method of claim 14, wherein the contact surface of the pole member and an axis along which the armature moves define an acute angle.

16. The method of claim 14, wherein a portion of a contact surface of the armature and a portion of the contact surface of the pole member define an air gap area within the flux path, the pole member and the armature configured such that the air gap area decreases as the armature moves from the first position to the second position.

17. The method of claim 14, wherein a portion of the armature is configured to move within the retainer, the portion of the armature and the retainer being included in the flux path.

18. The method of claim 17, wherein:

the portion of the armature includes a sliding surface; and the retainer includes a surface, the sliding surface of the armature and the surface of the retainer define an air gap area within the flux path, the retainer and the armature configured such that the air gap area decreases as the armature moves from the first position to the second position.

19. The method of claim 14, wherein:

a portion of the contact surface of the armature and a portion of the contact surface of the pole member define a first air gap area within the flux path, the pole member and the armature configured such that the first air gap area decreases as the armature moves from the first position to the second position, a sliding surface of the armature configured to move within the retainer, the sliding surface and a surface of the retainer define a second air gap area within the flux path, the retainer and the armature configured such that the second air gap area decreases as the armature moves from the first position to the second position.

20. A method, comprising:

energizing a solenoid coil of a pump assembly to move an armature from a first position to a second position within a solenoid housing, the armature coupled to a pump element, the solenoid housing, a pole member, the armature and a retainer collectively defining a flux path, a first surface of the armature spaced apart from a contact surface of the pole member by a first air gap when the armature is in the first position, the first surface of the armature in contact with the contact surface of the pole member when the armature is in the second position, the contact surface of the pole member defining an outer diameter that is between an outer diameter defining the contact surface of the armature and an inner diameter defining the contact surface of the armature, a second surface of the armature spaced apart from a surface of the retainer portion by a second air gap, a portion of the first surface of the armature and a portion of the contact surface of the pole member defining the first air gap area within the flux path, the pole member and the armature configured such that the first air gap area decreases as the armature moves from the first position to the second position; and deenergizing the solenoid to move the armature from the second position to the first position within the solenoid housing.

* * * * *